310-322 SR
E4819 OR 4,376,232

[redacted]

United State [redacted] 4,376,232

Martin [redacted] Mar. 8, 1983

[54] ELECTRO-ACOUSTIC TRANSDUCER

[75] Inventor: Erwin Martin, Munich, Fed. Rep. of Germany

[73] Assignee: Siemens Aktiengesellschaft, Berlin & Munich, Fed. Rep. of Germany

[21] Appl. No.: 239,580

[22] Filed: Mar. 2, 1981

[30] Foreign Application Priority Data

Feb. 29, 1980 [DE] Fed. Rep. of Germany ..... 3007808

[51] Int. Cl.[3] ..... H04R 15/00

[52] U.S. Cl. ..... 179/110 A; 179/180; 310/322; 181/151; 181/160

[58] Field of Search ..... 179/110 A, 180, 178, 179/179; 310/322, 324, 326, 327; 181/157, 160, 182, 151, 293

[56] References Cited

U.S. PATENT DOCUMENTS 4,292,561 9/1981 Martin ..... 179/180 X

FOREIGN PATENT DOCUMENTS 2831411 1/1980 Fed. Rep. of Germany .

*Primary Examiner*—Benjamin R. Fuller
*Attorney, Agent, or Firm*—Hill, Van Santen, Steadman, Chiara & Simpson

[57] ABSTRACT

The invention concerns an electro-acoustical transducer with a transducer plate having a piezo electric layer and which subdivides the housing of the transducer into a front and back chamber. In the front chamber, means are provided for the attenuation of resonance increases comprising Helmholtz resonators and an attenuation disc. According to the invention, the Helmholtz resonators are designed in such a manner that their effective surface is not reduced in size by means of the attenuation disc or wafer. This is attained according to the invention in that slots are formed in a separating plate.

3 Claims, 2 Drawing Figures

ELECTRO-ACOUSTIC TRANSDUCER

BACKGROUND OF THE INVENTION

The invention relates to an electro-acoustic transducer comprising a transducer plate which is arranged in a housing and by which the space in the housing is divided into a front chamber and a rear chamber. A fitting or cover which seals off the front chamber is provided with sound openings. The front chamber contains Helmholtz chambers and means for attenuating rises in resonance, and also has a baffle plate arranged therein between the plate and the fitting. The fitting and baffle plate are provided with sound openings and the sound openings in the fitting are offset relative to the sound openings of the baffle plate. Means are also provided which possess attenuating properties in the region of the baffle plate and which cover the sound openings of the baffle plate.

A transducer constructed in this way is known. The means arranged in the front chamber defined by the transducer plate serve in particular to reduce the resonance increase of the fourth subharmonic characterized by a nodal circle. In this respect the described means form an acoustic low-pass filter whose mass action and attenuating action is strengthened by the porous attenuating plate between the fitting and the baffle plate.

SUMMARY OF THE INVENTION

An object of the invention is to improve upon the acoustic low-pass filter in such manner that it becomes independent of any divergencies in the attenuating plate in order to thus avoid disadvantageous influences upon the frequency response tolerance and reference attenuation tolerance. This object is realized in accordance with the invention in that the sound openings in the baffle plate are formed by a plurality of slots which are narrow relative to the sound openings of the fitting or cover.

As a result of these techniques, the sound openings in the baffle plate are replaced by narrow slots. Thus the attenuation in the slots of the baffle plate predominates when the attenuating plate or disc consists of relatively penetratable foam. In this way even material divergencies of the attenuating plate only insubstantially influence the frequency behavior of the acoustic low-pass filter.

An expedient embodiment consists in that the narrow slots are assembled to form groups and that a group of this kind is in each case adjoined by an extended opening in the baffle plate.

As a result of such a technique, the length of the slots can be varied independently of the thickness of the baffle plate.

A particularly expedient embodiment consists in that the extended opening or recess faces towards the space between the fitting and the baffle plate, whereas the narrow gaps face towards the space between the transducer plate and the baffle plate. This assures a free access for air to the slots, quite independently of the attenuating plate or disc.

DESCRIPTION OF THE PREFERRED EMBODIMENTS

Figures 1, 2:
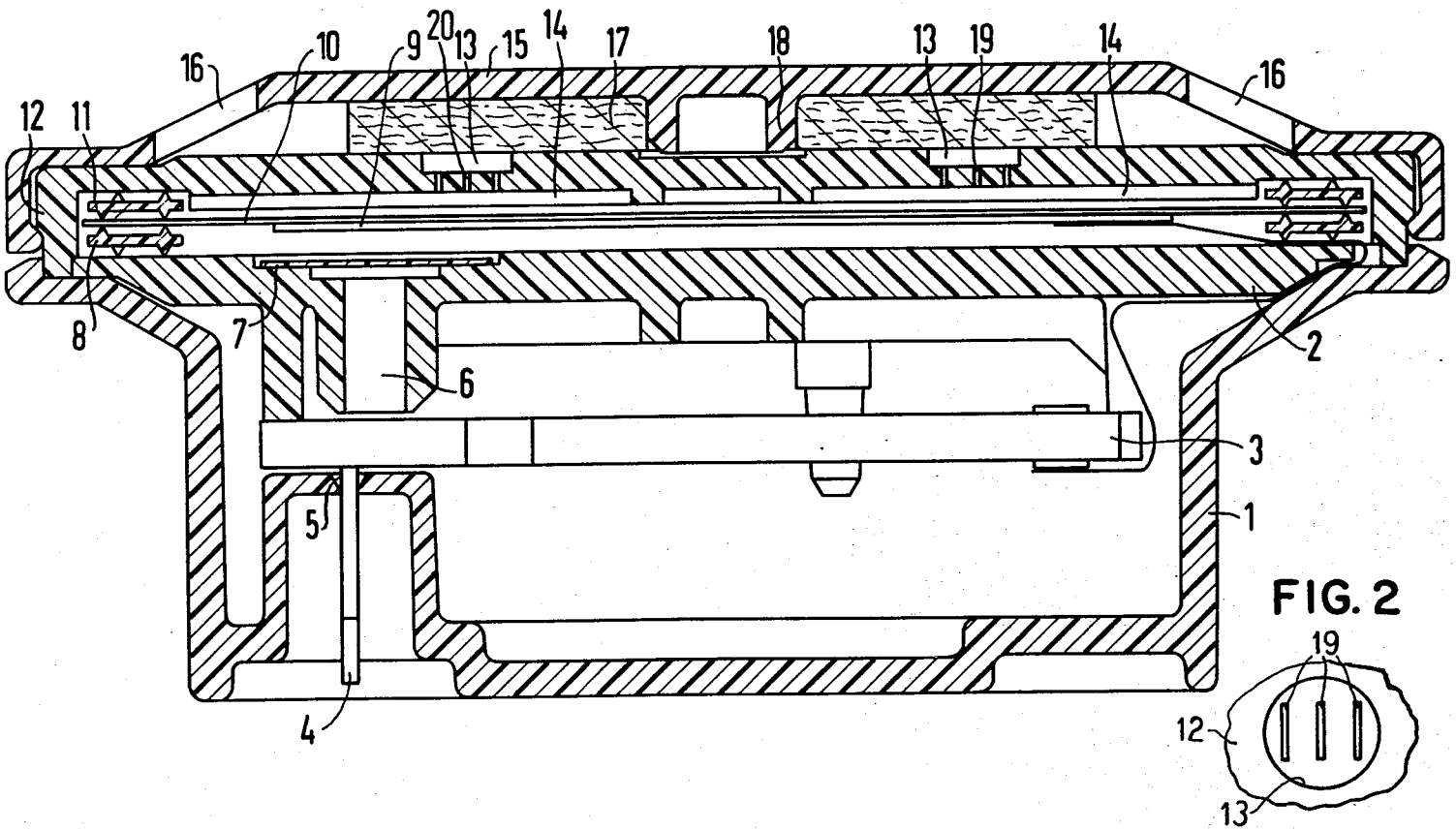
FIG. 1 is a sectional view of an electro-acoustic transducer.
FIG. 2 is a plan view of the recess with slots according to the invention.

In FIG. 1, the following components are accomodated consecutively in a housing 1. First, we have the carrier 2 which, on its side facing towards the base of the housing 1, bears a circuit board 3 provided with electronic components. On this circuit board are arranged two knife switch or contact prongs (knife switch prong 4 has been shown) which project through recesses 5 in the housing which form the external electric terminal, and which secure the carrier 2 with the circuit board 3 in the housing. The carrier 2 is provided with two absorption resonators, of which the absorption resonator 6 covered by a silk disc 7 has been illustrated.

Also arranged on the carrier 2 is a bearing body 8 above which is mounted a transducer plate 10 provided with a piezoceramic coating 9. A further bearing body 11 forms the counter bearing. The housing 1 is sealed by a baffle plate 12 which is indivisibly connected to the housing. This baffle plate possesses a plurality of sound openings or recesses 13 which are arranged in the form of a circle and which are in each case adjoined by a group of narrow slots 19, 20. All of the recesses 13 with slots 19, 20 lie radially inwardly of the sound openings 16 so that sound travels laterally through the attenuating disc 17. Here the arrangement of the slots is selected to be such that they face towards the area directly in front of the transducer plate. On the side facing towards the transducer plate, the baffle plate is provided with ribs 14 which extend radially outwardly.

The transducer formed in this way is closed off by a fitting or cover 15 which again possesses sound openings 16 arranged in the form of a circle. These sound openings are arranged in a circle which has a larger diameter than the sound openings arranged in the baffle plate. Between the baffle plate and the fitting or cover there is arranged an attenuating disk 17 which is mounted in a cylindrical attachment 18 of the fitting and which partially fills the space in front of the baffle plate. Here the attenuating plate is designed such that it covers the sound openings of the baffle plate.

In FIG. 2, an enlarged plan view of the recess 13 with slots 19, 20 are shown.

Although various minor modifications may be suggested by those versed in the art, it should be understood that I wish to embody within the scope of the patent warranted hereon all such modifications as reasonably and properly come within the scope of my contribution to the art.

I claim as my invention:

1. An electro-acoustic transducer, comprising:

a transducer plate arranged in a housing and which divides space within the housing into a front chamber and a rear chamber;

a cover or fitting closing off the front chamber and provided with sound openings;

the front chamber containing means for attenuating rises in resonance comprising a baffle plate arranged in the front chamber between the transducer plate and the cover, and wherein the cover and the baffle plate are provided with sound openings, the sound openings of the cover being arranged offset relative to the sound openings of the baffle plate;

means possessing attenuating properties in the region of the baffle plate and which cover the sound openings of the baffle plate;

the sound openings of the baffle plate being formed by a plurality of slots which are narrow in relation to the sound openings of the cover; and the narrow slots being assembled to form groups and each such group being adjoined by an extending opening or recess in the baffle plate.

2. An electro-acoustic transducer as claimed in claim 1 wherein the recess faces towards a space between the cover and the baffle plate, whereas said narrow slots face towards a space between the transducer plate and the baffle plate.

3. An electro-acoustic transducer, comprising:

a transducer plate arranged in a housing and which divides space within the housing into a front chamber and a rear chamber;

a cover closing off the front chamber and provided with sound openings;

the front chamber containing a baffle plate having a plurality of sound openings all of which lie radially inwardly of the sound openings of the cover;

an attenuating material covering the sound openings of the baffle plate and positioned in a space between the baffle plate and cover;

the sound openings of the baffle plate comprising narrow rectangular slots having a width substantially less than a diameter of the sound openings in the cover; and the baffle plate sound openings comprising a recess providing an air space beneath the attenuating material, said slots being provided in a base of said recess.

* * * * *